United States Patent [19]

Reynolds

[11] 4,095,715

[45] Jun. 20, 1978

[54] PUSHER PLATE FOR FORKLIFT VEHICLES

[76] Inventor: Teri Gene Reynolds, 201 E. Sangamon, Fisher, Ill. 61843

[21] Appl. No.: 791,699

[22] Filed: Apr. 28, 1977

[51] Int. Cl.[2] ..... B66F 9/12

[52] U.S. Cl. ..... 214/620; 214/8.5 SS; 214/514

[58] Field of Search ..... 214/620, 621, 750, 8.5 C, 214/8.5 SS, 514

[56] References Cited

U.S. PATENT DOCUMENTS

| | | | |
|---|---|---|---|
| 3,157,301 | 11/1964 | McWilliams | 214/514 |
| 3,381,834 | 5/1968 | Gibson | 214/620 |

FOREIGN PATENT DOCUMENTS

| | | | |
|---|---|---|---|
| 220,547 | 3/1962 | Austria | 214/514 |

*Primary Examiner*—Drayton E. Hoffman
*Assistant Examiner*—Ross Weaver
*Attorney, Agent, or Firm*—Wegner, Stellman, McCord, Wiles & Wood

[57] ABSTRACT

An L-shaped pusher plate adapter for transverse mounting on the ends of the tines of a forklift carrier or similar vehicle, especially for use in conjunction with a load push-pull attachment. The adapter comprises an abutment wall with means for mounting said abutment wall on the tines of the fork.

7 Claims, 5 Drawing Figures

PUSHER PLATE FOR FORKLIFT VEHICLES

BACKGROUND OF THE INVENTION

1. Field of the Invention

This invention relates to apparatus used in connection with a forklift vehicle and, more particularly, to an adapter for mounting on the ends of the tines of the fork of said vehicle for use in transferring material from a stack to the fork.

2. Description of the Prior Art

In handling stacked cartons, a wooden pallet is often replaced by a cardboard pallet or slip-sheet. When such a cardboard slip-sheet is used, forklifts used in handling the cartons are fitted with a load push-pull mechanism, such as manufactured by Cascade Corporation, Portland, Oregon.

A load push-pull mechanism typically includes a push plate upstanding from the fork of a forklift and extending transversely thereacross, and hydraulically actuated for forward or rearward movement along the tines. A clamping mechanism extends along the lower edge of the push plate.

When removing cartons from a stack, the push plate is advanced to the front of the fork and the fork positioned directly below the cardboard pallet. The clamping mechanism grips the edge of the cardboard pallet and pulls the pallet and the cartons from the stack onto the tines of the forklift. The pulling action on the cardboard may cause the cartons below the cardboard to tilt in the direction of the pulling force i.e., toward the tines of the forklift. The tilting cartons may be pierced by the ends of the tines, thereby damaging the contents of the cartons and hampering the efficiency of the unloading operation.

The above operation is described in detail in Turner U.S. Pat. No. 2,601,932. Turner provides a forklift whose support surface comprises, in lieu of tines, a steel apron with a relatively blunt chisel end extending the width of the apron. When stacked cartons are pulled into position on the steel apron, the chisel end acts to steady the cartons below the pallet.

In modern industry, wooden pallets are often used to support stacked material. A multi-tined fork lift is required in order to effectively handle this type of pallet and material stacked thereon due to the compartmental structure of the pallet. The use of a chisel end, as shown in Turner U.S. Pat. No. 2,601,932, is not appropriate when tines are provided on the forklift, due to the relatively narrow width of the ends of the tines.

SUMMARY OF THE INVENTION

It is an object of the present invention to provide a push plate adapter for a forklift vehicle whereby a conventional load push-pull mechanism may be used in cooperation with such a vehicle for handling stacked cartons without damage to other cartons in the stack.

It is another object of the invention to provide a push-plate adapter for mounting on the tines of a forklift having a push-pull mechanism whereby the forklift may be easily modified for use with wooden pallets or with cardboard pallets.

More particularly, it is an object of the invention to provide a push plate adapter for mounting transversely on the ends of the tines of a forklift whereby a wall is provided for abutment against the cartons stacked immediately below a cardboard slip-sheet or pallet, and a support shelf is provided for mounting on the tines, generally parallel thereto. The abutment wall and the support shelf are disposed at right angles to each other and include means to allow quick and simple mounting and removal from the forklift tines.

DETAILED DESCRIPTION OF THE INVENTION

Figure 1:
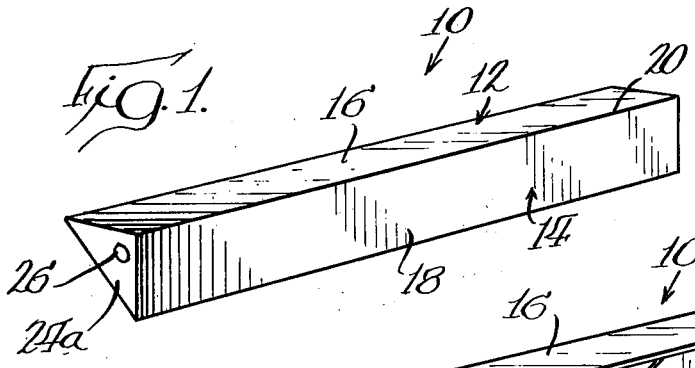
FIG. 1 is a perspective view of a fork-lift adapter embodying the features of the present invention.

Referring to FIG. 1, an adapter 10 for mounting on the tines of a forklift or similar vehicle is shown. The adapter 10 is provided with mutually perpendicular surfaces 12 and 14. The surface 12 is on a shelf 16 and the surface 14 is on a wall 18. The shelf 16 and the wall 18 illustratively and preferably comprise rigid metal plates and are integrally formed in an L-shaped configuration, as by welding along the joint 20, for example. It is to be understood that the shelf 16 and the wall 18 may be sections of a unitary structure formed by bending, and no unnecessary limitation should be implied from the fact that a welded construction is illustrated.

A triangular support bracket **24*a* is shown interposed between the shelf 16 and the wall 18. As may be seen in FIGS. 2, 3 and 5, a plurality of support brackets 24*a–g* may be provided. A circular hole 26 in the triangular bracket 24 of FIG. 1 is one end of a tubular gripping means (not shown in FIG. 1) used for handling the adapter 10. The support brackets 24*a–g* and the gripping means may be secured to the structure of the adapter 10** by any convenient means, such as welding, for example.

Figure 2:
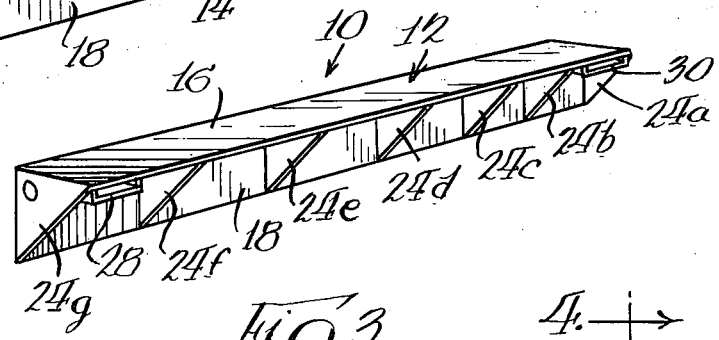
FIG. 2 is a further perspective view of the adapter of FIG. 1.

Referring now to FIG. 2, the adapter 10 of FIG. 1 is viewed oppositely from the view of FIG. 1. The triangular support brackets **24*a–g* are interposed between the shelf 16 and the wall 18 to provide support therefor, such support being in addition to the inherent structural strength of the adapter 10**.

Channels 28 and 30 are secured, as by welding, to the underside of the shelf 16. Each of the channels 28 and 30 is of a generally rectangular shape and corresponds to the shape of the end of a forklift tine. The channels 28 and 30 comprise means for mounting the adapter 10 to the tines of a forklift vehicle. Other means may be employed to mount the adapter 10 to the tines, it being essential only that the ends of said tines not penetrate the wall 18, for reasons that are explained below.

Figure 3:
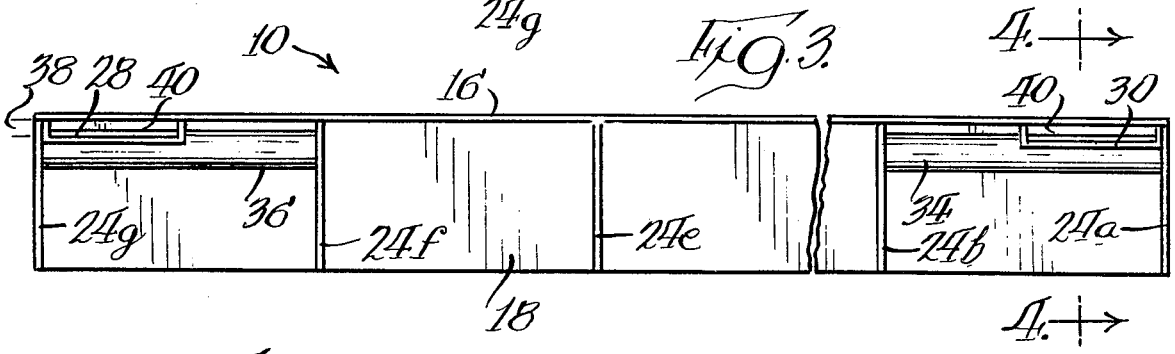
FIG. 3 is a broken elevational view of the adapter of FIGS. 1 and 2.

Referring now to FIG. 3, details of the construction of the adapter 10 are shown. Interposed between the pair of brackets **24*a* and 24*b* and the pair 24*f* and 24*g*, are gripping means 34 and 36, comprising cylindrical tubes. The gripping means 34 and 36 aid in maneuvering the adapter 10, as in mounting or removing the adapter 10 to or from forklift tines. The gripping means 34 and 35 need not be disposed at any particular point along the length of the adapter 10, nor need they be attached to brackets, but may be attached to either the shelf 16 or the wall 18, or both. However, the construction shown in FIG. 3** provides good leverage and a simple design.

It is obvious that the gripping means 34 and 36 need not be cylindrical tubes but may be of any suitable shape.

Figure 4:
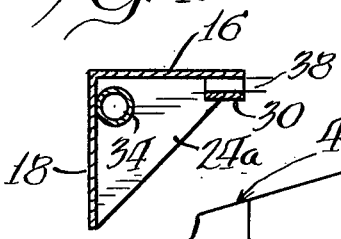
FIG. 4 is a cross-sectional view of the adapter of FIG. 3 taken substantially along line 4—4 of FIG. 3.

The channels 28 and 30, illustrated in FIGS. 3 and 4, are formed from U-shaped parts welded to the underside of the shelf 16. The positions of the channels 28 and 30 in FIGS. 3 and 4 are illustrative only, and the channels 28 and 30 may be located at other points along the underside of the shelf 16. The vertical dimension 38 of the opening 40 in each channel 28 and 30 must be at least as great as the vertical dimension of the ends of the tines of a forklift vehicle, with the horizontal dimension 42 of the channel 28 or 30 being at least as wide as said ends.

Figure 5:
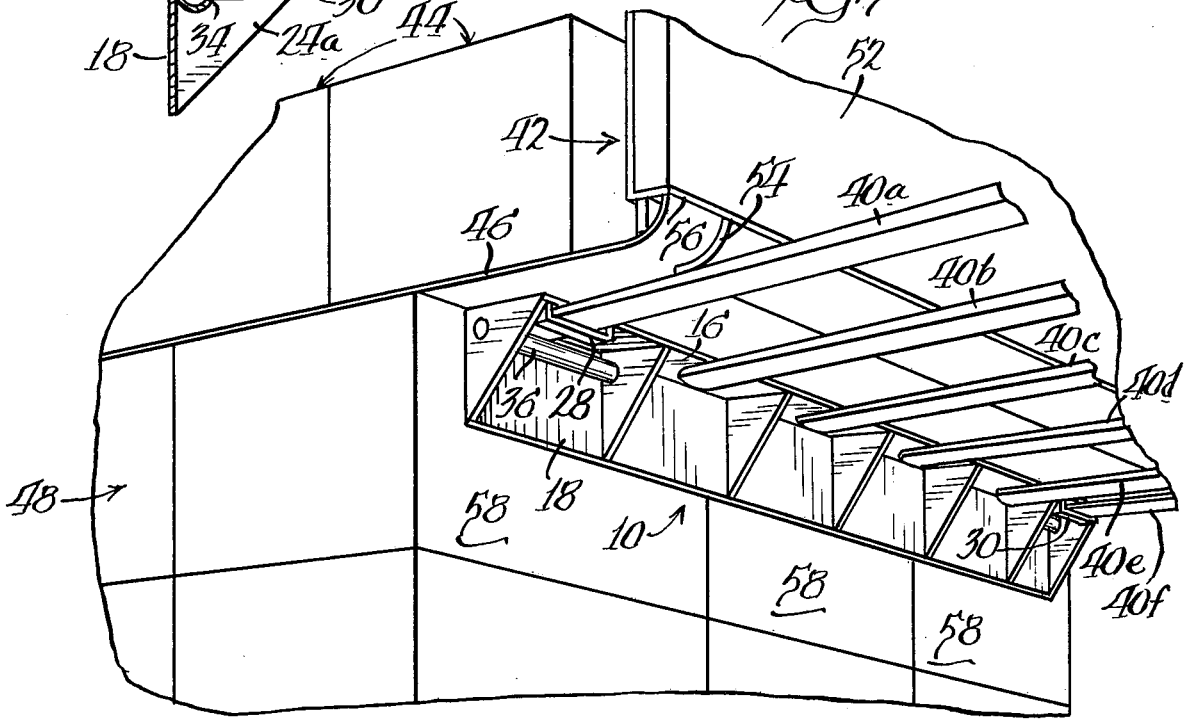
FIG. 5 is a perspective view of the adapter of FIGS. 1–4 in place upon the tines of a forklift and cooperating with a load push-pull mechanism to unload stacked cartons of material.

FIG. 5 shows an adapter 10 in place upon the tines 40*a–f* of a forklift vehicle (not shown). The tines 40*a–f* and the adapter 10 are illustrated in use in cooperation with a push-pull mechanism 42 to unload a group 44 of stacked cartons positioned on a cardboard slip-sheet or pallet 46. A group 48 of stacked cartons is located immediately below the slip-sheet 46 and provides support for the group 44.

The load push-pull mechanism 42 includes a pusher plate 52 actuated by hydraulic or other means (not shown). Clamping means 54 are provided along the lowermost edge 56 of the pusher plate 52 and serve to grip and apply pulling force to the slip-sheet 46.

In operation, one edge 56 of the slip-sheet is exposed when the groups 44 and 48 of stacked cartons are aligned. When the tines 48*a–f* of the forklift are positioned directly under the edges 56, the pusher plate 52 of the push-pull mechanism may be advanced to allow the clamping means 54 to engage the edge 56. With the clamping means 54 and the edge 56 so engaged, the pusher plate 52 is retracted along the tines 40*a–f* of the forklift, thereby pulling the slip-sheet 46 and the group 44 of cartons onto the tines 48. The group 44 frictionally engages the slip-sheet 46 so as to preclude slippage thereof from under the cartons.

The slip-sheet 46 also frictionally engages the upper surfaces of the cartons in the group 48, thereby exerting a pulling force upon those cartons. Without restraint, the pulling force would cause the group of cartons 48 to tilt toward the tines 40*a–f*, thereby causing possible damage to the cartons and their contents.

With the adapter 10 in place on the tines 40*a–f*, however, the wall 18 exerts a force on the upstanding sides 58 of the group of cartons 48 so as to counteract the pulling force provided by the push-pull mechanism 42. Impalement of the cartons is prevented by the relatively large, continuous abutment surface 14 of the wall 18.

Additionally, the shelf 16 provides a continuous support surface 12 over the which the cardboard pallet 46 may slide as it is drawn onto the surface of the tines 40*a–f*.

I claim:

1. A pusher plate for use with a forklift carrier having a load push-pull mechanism with a slip-sheet pallet clamp, to remove a sheet supported load from a stack, comprising:

an abutment wall;

means for mounting the abutment wall on the free end of the tines of the fork with the wall extending the width of the fork and downwardly from the fork to engage and prevent displacement of the supporting stack below the slip-sheet as the slip-sheet and the load thereon are removed by the load push-pull mechanism.

2. The pusher plate of claim 1 wherein said mounting means comprises at least one channel extending rearwardly from said abutment wall.

3. The pusher plate of claim 1 wherein a support shelf extends rearwardly from the top of said abutment wall and in substantially perpendicular relation thereto.

4. The pusher plate of claim 3 wherein a plurality of triangular support brackets are interposed between said abutment wall and said support shelf.

5. The pusher plate of claim 4 wherein at least one handle is secured to one of said abutment wall or said support shelf or between adjacent support brackets.

6. A pusher plate for mounting on the tines of a forklift or similar vehicle, said pusher plate comprising:

an abutment wall and a support shelf integrally joined in substantially perpendicular relation, and means for mounting at least one of said abutment wall or said support shelf to the free end of said tines to dispose said abutment wall below and in substantially perpendicular relation to said tines.

7. The pusher plate of claim 1 wherein said abutment wall and said support shelf each comprises a rigid plate.

* * * * *